United States Patent [19]

Lackey et al.

[11] Patent Number: 4,756,108

[45] Date of Patent: Jul. 12, 1988

[54] DISPLAY FRAME

[75] Inventors: Robert W. Lackey, Hickory, N.C.; Gregory A. Harris, Avondale Estates, Ga.

[73] Assignee: McCalla-Lackey Associates, Inc., Norcross, Ga.

[21] Appl. No.: 874,421

[22] Filed: Jun. 16, 1986

[51] Int. Cl.[4] ..... G09F 7/02

[52] U.S. Cl. ..... 40/611; 40/585; 40/619

[58] Field of Search ..... 40/10 R, 601, 611, 619, 40/574, 584, 585, 568, 569, 152, 152.1, 156; 312/281, 282

[56] References Cited

U.S. PATENT DOCUMENTS

| | | | |
|---|---|---|---|
| 310,988 | 1/1885 | Cilley | 40/10 R |
| 832,338 | 10/1906 | Northup | 40/10 R |
| 1,065,875 | 6/1913 | Keagy et al | 40/10 R |
| 1,182,318 | 5/1916 | Rose | 40/10 R |
| 1,251,248 | 12/1917 | Larson | 40/574 |
| 1,557,260 | 10/1925 | Leu et al. | 40/611 |
| 1,804,871 | 5/1931 | Helland | 40/10 R |
| 2,029,221 | 1/1936 | Burgess et al. | 40/574 |
| 2,568,165 | 9/1951 | Oberding | 40/611 |
| 3,013,475 | 12/1961 | Spangler | 40/574 |
| 3,611,604 | 10/1971 | Saltzman | 40/152 |
| 4,158,266 | 6/1979 | Gilmour | 40/152 |
| 4,337,590 | 7/1982 | Jackson | 40/10 R |
| 4,571,865 | 2/1986 | Ackeret | 40/10 R |
| 4,583,309 | 4/1986 | Kane et al. | 40/152 |

*Primary Examiner*—Carl D. Friedman
*Assistant Examiner*—Michael Safavi
*Attorney, Agent, or Firm*—Needle & Rosenberg

[57] ABSTRACT

The present invention comprises a frame which has a transparent window, such as glass, secured within it. The frame is attached at the bottom by hinges to vertical support members which are to be mounted to the wall or other surface where the display frame is to be installed. As a result, when in place, the frame moves downward when opened. A damping device is connected between the frame portion and a support member to greatly restrict the speed of movement of the frame and to provide support for the frame as it is opened. Preferably, the frame is held open in a generally horizontal position by the limit of travel in the damper.

10 Claims, 2 Drawing Sheets

DISPLAY FRAME

BACKGROUND OF THE INVENTION

This invention pertains to display frames for posters, advertisements and other printed matter intended to be publicly displayed. More specifically, this invention describes an improved display device which is economical in construction and allows the display material to be simply installed and removed from the display.

Prior display devices include billboards and poster display frames of various designs. Billboards are generally vertical flat surfaces upon which the printed material to be displayed is attached, usually by some form of adhesive. Prior art display frames generally have a back solid surface portion upon which the printed material is secured with a frame portion which installs over the displayed material to the back portion. Since one main purpose of display frames is to protect the displayed material, glass or other transparent material is usually installed within the frame portion and the frame portion is generally locked in place when installed to display the material. The frame portion is either totally removable from the back portion, or is connected by hinges to the back portion at either one side or the top of the frame portion.

It is often a time consuming process to use either type of prior art display device, especially when display material is changed often or there are many such displays which must be changed. Clearly, billboards which require gluing of printed matter are not practical for most use and by untrained people. Even with prior art display frames, changing display materials is not a simple matter. The frame portion may be heavy and difficult or dangerous to open. The placement of the display material requires means to attach it to the back portion. Furthermore, correct positioning of the display material may be time consuming, especially if multiple items or items smaller than the dimensions of the frame are to be displayed.

Prior art display devices have been either free standing or installed against solid surfaces, such as walls and buildings. Even when prior art display frames were to be installed on solid surfaces, a complete enclosure, including the back portion, was required.

SUMMARY OF THE PRESENT INVENTION

The present invention is of the display frame type. However, it is specifically designed to be installed on solid surfaces, such as walls.

The present invention comprises a frame which has a transparent window, such as glass, secured within it. The frame is attached at the bottom by hinges to vertical support members which are to be mounted to the wall or other surface where the display frame is to be installed. As a result, when in place, the frame moves downward when opened. A damping device is connected between the frame portion and a support member to greatly restrict the speed of movement of the frame and to provide support for the frame as it is opened. Preferably, the frame is held open in a generally horizontal position by the limit of travel in the damper. Alternatively, a separate support chain may be connected between the frame portion and a support member to restrict the downward travel of the frame.

A compressible insert fits within the frame and is at least thicker than the width of the frame (i.e., the distance between the window and the supporting surface when the frame is closed). Preferably, the insert is of light weight material, such as foam, so that it may be easily removed and replaced. Thus, the insert may be removed from the frame portion when open, material to be displayed may be easily placed and positioned on the window of the horizontal frame, and the foam insert placed over the display material. By lifting the frame back to its upright closed position, the backing is compressed between the window and the support surface to hold the display material in place.

The frame is secured in the closed position by a latch means, which may be lockable. Preferably, such a lock is incorporated within the side of the frame and cooperates with latch receiving means in the vertical support members.

Therefore, it is an object of the present invention to provide a display frame in which the display material may be easily inserted and removed.

It is a further object of the present invention to provide a display frame which is economical in construction and easily installed.

These and other objects and advantages will appear from the following description with reference to the drawings.

DETAILED DESCRIPTION OF THE PREFERRED EMBODIMENT

The preferred embodiment is now described with reference to the drawings, in which like numbers indicate like parts throughout the figures.

Figures 1, 2:
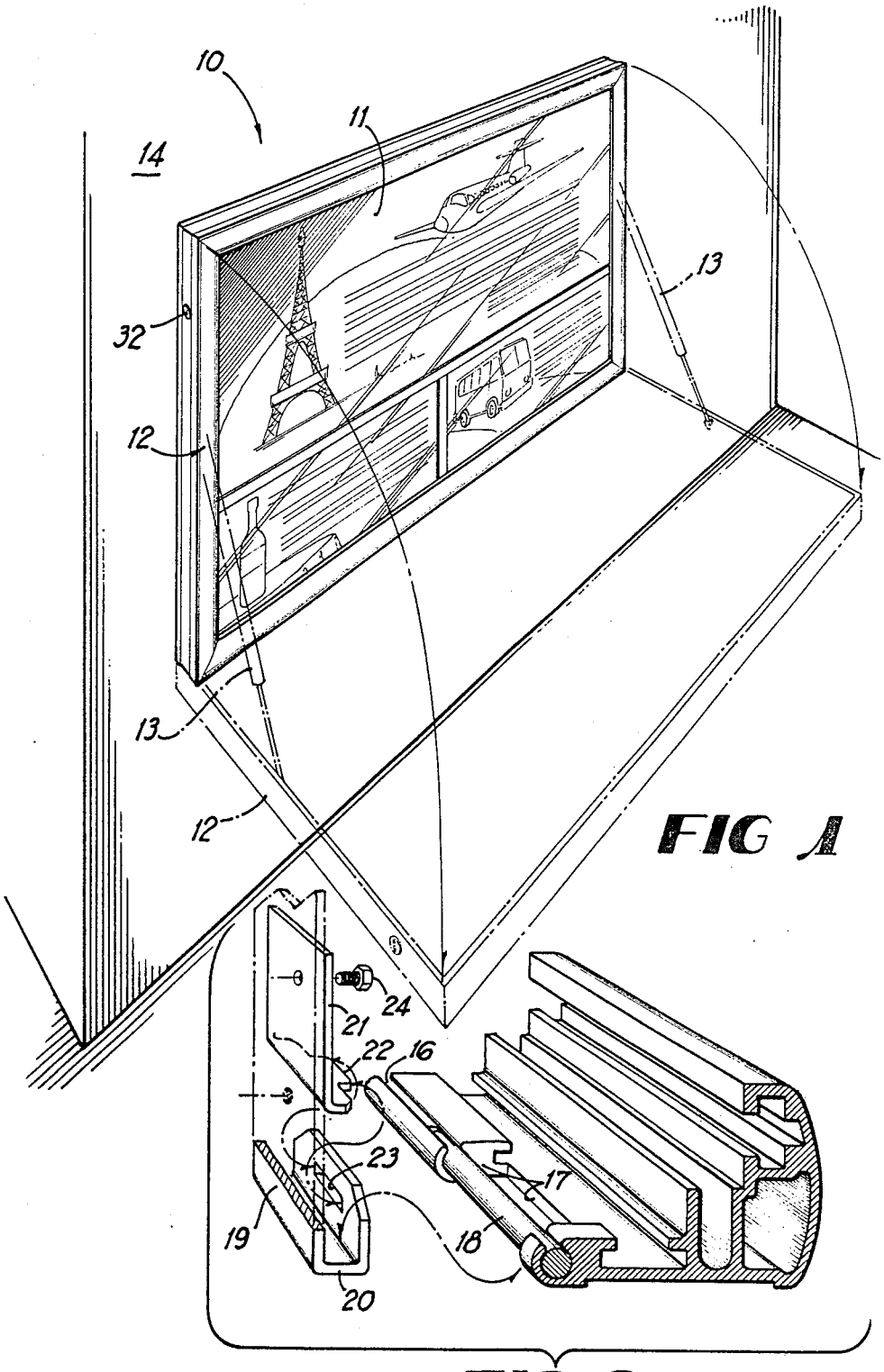
FIG. 1 is a front perspective view of the display frame of the present invention.
FIG. 2 is an enlarged partial cross section view of a portion of the frame including a hinge.

FIG. 1 shows a display device 10 of the present invention in perspective in its intended use as mounted on a wall 14. Printed display material 11 is displayed through a transparent window within a frame portion 12. As described in greater detail below, the frame portion is hinged at the bottom, so that it opens forward and downward, as shown by the arrows and ghost lines in FIG. 1.

FIG. 2 illustrates a hinge of the preferred design for the described embodiment of the invention. The frame portion itself is comprised of two vertical and two horizontal extruded elements 15 joined at the corners to form a frame. FIG. 2 shows a section through the lower horizontal element 15 which forms the bottom of the frame. The extruded element includes a partial cylindrical opening 16 along one edge. A portion of the edge is cut away to form the hinge opening 17 and a pin 18 is inserted within the cylindrical opening across the width of opening 17 to form the pivot of a hinge. Wall support element 19 has a U-shaped lower end 20 for receiving the pin 18 of the hinge. A locking element 21 has a tab 22 which fits into receiving slot 23 and is secured to support element 19 by screw 24. The locking element holds the pin 18 within the U-shaped lower end 20 to form a complete hinge.

Figure 3:
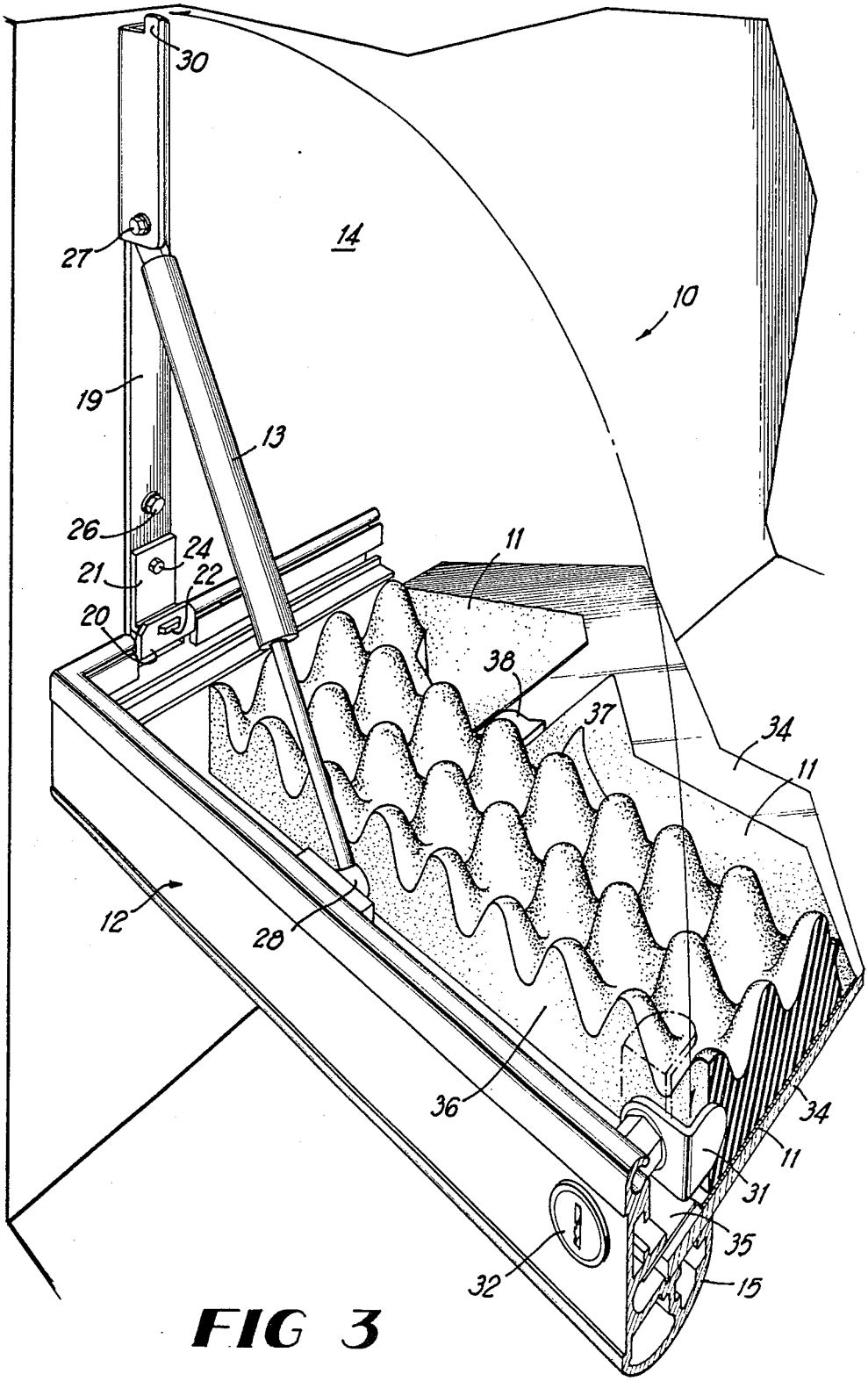
FIG. 3 is a partial section view in perspective of the elements of the display frame.

FIG. 3 shows a cut-away portion of the display device in partial section and in the open position. FIG. 3 shows one of two support elements 19 which are located adjacent to each of the side elements of frame 12.

Support element 19 is affixed to the wall 14 or other vertical solid surface by bolts 26 along its vertical length by means sufficient to support the total weight of the display device. In addition to being connected to the frame 12 at the hinge formed at its U-shaped lower end 20, support element 19 is connected to the frame by damper 13. The damper 13 is pivotally connected to support element 19 at a point 27 located near the top of the support element and is also pivotally connected to the frame at a point 28 generally away from the bottom of the frame, but such that when the frame is closed the damper fits between connections 27 and 28. The damper may be a gas spring, such as a 3000 psi nitrogen gas type. The purpose of the damper is to limit the rate of descent of the frame 12 when it is opened and allowed to fall away from the wall such that the frame may be conveniently and safely opened without involvement of significant human force.

The damper 13 may also serve to hold the frame 12 in a horizontal open position defined by the limit of travel in the piston arms of the dampers 13. Alternatively, a chain may be connected between support element 19 and frame 12 of suitable length to support the frame in an open position.

FIG. 3 also shows a catch 30 at the top of support element 19 and a corresponding latch 31 which is an extension of lock 32 located in the side of frame 12. Thus, the frame may be locked by key in the closed position so that unauthorized persons may not open the frame and access the display materials.

Window 34, which may be glass, fits within the frame 12 and may be secured in place by shims 35. Compressible insert 36 fits within the frame 12 and has at least one flat surface area approximately the size of the inside of the frame 12. The compressible insert 36 is at least as thick as the width of the frame so that it is compressed between the wall 14 and the window 34 when the frame 12 is closed. By placing the display material 11 between the window 34 and the compressible insert 36 the display material is held flat against the window and in place. Preferably, the compressible insert is made of lightweight foam so that is may be easily removed when the frame is open for removal and replacement of display material. The flat face of the foam has a high friction coefficient to keep the display material from sliding.

The other face of the compressible insert may be undulating such that the peaks 37 are compressed when the frame is closed and the force evenly distributed about the flat face. This may help reduce the amount of force required to close the frame while still providing the advantages of the invention.

Additionally, dividing inserts 38 may be incorporated in the frame to help support partial height display material or simply to provide visual dividers in front of the display material.

Thus, it is seen that the present invention may be mounted on a solid surface and that the display device itself requires only two vertical supports as a back portion, relying on the wall or other solid surface to form the back of the display. The foam or other compressible insert conforms to any uneven portion of the solid surface yet provides relatively uniform support for the display material.

While this invention has been described in detail with particular reference to the preferred embodiment thereof, it will be understood that variations and modifications can be effected within the spirit and scope of the invention as previously described and as defined in the claims.

What is claimed is:

1. A display device, attached to a vertical solid surface which comprises:

a rectangular display frame having a top, a bottom and two sides forming an open area for display;

a transparent window occupying the full open area of said frame to provide a front supporting and protective surface to material displayed in said frame;

means for hingably mounting the bottom of said frame to the vertical solid surface;

damping means, which continuously controls the rate of descent of said frame when being opened from a vertical position to a generally horizontal position, connected between said frame and the vertical solid surface and means for retaining said frame, when said frame is mounted by said mounting means to the vertical solid surface, in a vertical position.

2. The display device of claim 1, wherein there is a distance between said window and the vertical solid surface which further comprises a compressible backing which fits within said frame and is at least as thick as the distance between said window and said vertical solid surface, such that backing is compressed between said window and the vertical solid surface when said frame is in the vertical closed position, for holding display material in place between said window and said compressible backing.

3. The display device of claim 2, wherein said compressible backing is a lightweight foam material.

4. The display device of claim 3, wherein said compressible backing has a flat surface for holding the display material against the window, and an undulating surface for contact with the vertical solid surface when said frame is closed.

5. The display device of claim 1, wherein said damping means comprises at least one fluid piston damper connected at one side of said frame.

6. The display device of claim 5, wherein said damper additionally stops the downward travel of said frame when opened in a substantially horizontal position.

7. A display device which comprises:

a rectangular display frame having a top, a bottom and two sides;

a transparent window mounted within said frame;

two elongated support members hingably connected to the bottom of said frame adjacent to the sides of said frame to be vertically mounted to a vertical supporting surface;

at least one damper connected between a side of said frame and an elongated support member which continuously controls the rate of descent of said frame when opened from a vertical position when said two elongated support members are mounted to a vertical supporting surface;

latching means on at least one side of said frame cooperating with the adjacent elongated support member for holding said frame in a vertical position when said two elongated support members are mounted to a vertical supporting surface.

8. The display device of claim 7, being mounted to a vertical solid surface, wherein there is a distance between said window and the vertical solid surface, which further comprises a compressible backing within said frame which is at least as thick as the distance between said window and the vertical solid surface when said frame is closed to the vertical display position, such that the backing is compressed between said window and the vertical solid surface for holding display material in place between said window and said compressible backing.

9. The display device of claim 8, wherein said frame is made of lightweight metal material and said compressible backing is a lightweight foam material.

10. The display device of claim 7, wherein said at least one damper comprises at least one fluid piston damper connected at one side of said frame.

* * * * *